US007614101B2

(12) United States Patent
Milbourne

(10) Patent No.: US 7,614,101 B2
(45) Date of Patent: Nov. 10, 2009

(54) LINEN COVER EXTENSION DEVICE AND METHOD OF USE

(76) Inventor: Susann D. Milbourne, P.O. Box 2725, Palm Beach, FL (US) 33480-2725

( * ) Notice: Subject to any disclaimer, the term of this patent is extended or adjusted under 35 U.S.C. 154(b) by 364 days.

(21) Appl. No.: 11/492,417

(22) Filed: Jul. 25, 2006

(65) Prior Publication Data

US 2008/0045114 A1 Feb. 21, 2008

(51) Int. Cl.
*A47G 9/02* (2006.01)
*A47C 31/00* (2006.01)

(52) U.S. Cl. ..... 5/490; 5/658

(58) Field of Classification Search ..... 5/490, 5/491, 737, 482, 488, 489, 658
See application file for complete search history.

(56) References Cited

U.S. PATENT DOCUMENTS

| | | | | | |
|---|---|---|---|---|---|
| 237,569 | A | | 2/1881 | Meech | |
| 1,741,311 | A | * | 12/1929 | Janowitch | 2/132 |
| 2,494,185 | A | * | 1/1950 | Magney | 2/132 |
| 2,964,756 | A | * | 12/1960 | Liebowitz | 2/132 |
| 3,039,112 | A | * | 6/1962 | Sucher | 2/132 |
| 3,686,692 | A | * | 8/1972 | Snare et al. | 2/132 |
| 4,118,803 | A | * | 10/1978 | Blau | 2/132 |
| 4,169,753 | A | * | 10/1979 | Wendell | 156/160 |
| 4,197,604 | A | | 4/1980 | Nakamura | |
| D308,786 | S | | 6/1990 | Draskovic | |
| 6,092,401 | A | * | 7/2000 | Sankey et al. | 70/18 |
| 2003/0140393 | A1 | * | 7/2003 | Friedman | 2/129 |
| 2003/0209576 | A1 | * | 11/2003 | Silbert | 223/83 |
| 2004/0016778 | A1 | * | 1/2004 | Thomas | 223/3 |
| 2006/0218695 | A1 | * | 10/2006 | Boos | 2/129 |
| 2007/0017100 | A1 | * | 1/2007 | Gringer et al. | 30/162 |

* cited by examiner

*Primary Examiner*—Peter M Cuomo
*Assistant Examiner*—Brittany M Wilson
(74) *Attorney, Agent, or Firm*—Raymond M. Galasso; Galasso & Associates LP

(57) ABSTRACT

A linen cover extension device and method of use are disclosed. In one form, a device for extending a portion of a fabric material of a linen cover at a corner edge of the linen cover is provided. The device includes an elongated substrate of flexible material having a length, a first end and a second end. The device further includes a coupling mechanism operable to secure the elongated substrate to the corner edge of the linen cover and extend a portion of the linen cover a distance from a perimeter of the linen cover.

9 Claims, 2 Drawing Sheets

LINEN COVER EXTENSION DEVICE AND METHOD OF USE

FIELD OF THE DISCLOSURE

The present invention generally relates to fabric designs, and more particularly, to a linen cover extension device and method of use.

BACKGROUND

Various types of linen materials may be purchased by consumers to create decorative interior designs within a home or office. A current trend by consumers includes placing multiple pillows on a couch, love seat, chair or bed to provide accent styling to a room. For example, a consumer may purchase a linen or comforter set for a bedroom that may include several linen covers such as pillow cases, pillow shames, etc. that may decoratively cover a pillow. Such conventional linen covers may be formed from various types of soft or non-rigid materials and may include a ruffled edge around a perimeter. For example, the ruffled edge may include a different material than a main body of the pillow sham but the ruffled edge may not be visible due to not having a pillow to provide support. In some conventional linen covers, additional stitching may be used to extend a ruffle portion away from a perimeter. However, this may increase the cost to manufacture a linen cover or may result in a less than aesthetically pleasing appearance. As such, what is needed is an inexpensive device for ensuring that a perimeter edge portion of linen cover may be extended away from a perimeter of a linen cover while having minimal impact on the overall appearance of the linen cover.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

A linen cover extension device and method of use are disclosed. According to one aspect, a device for extending a portion of a fabric material of a linen cover at a corner edge of the linen cover is provided. The device includes an elongated substrate of flexible material having a length, a first end and a second end. The device further includes a coupling mechanism operable to secure the elongated substrate to the corner edge of the linen cover and extend a portion of the linen cover a distance from a perimeter of the linen cover.

According to another aspect of the invention, a linen cover operable to be used with a device for extending a portion of a fabric material of the linen cover at a corner edge of the linen cover. The linen cover includes a material formed into a cover sized to extend over a pillow and including a perimeter edge portion formed into a ruffle. The cover further includes a cavity formed from the material at a corner of the cover and operable to receive the device to extend the ruffle a distance from the perimeter edge portion.

According to a further aspect of the invention, a device for extending a portion of a fabric material of a linen cover at a corner edge of the linen cover is provided. The device includes an elongated substrate of flexible material having a length between approximately two (2) inches and three (3) inches and a width no greater than approximately one quarter of an inch. The device further includes a coupling mechanism operable to secure the elongated substrate to the corner edge of the linen cover and extend a portion of the linen cover a distance from a perimeter of the linen cover.

Figure 1:
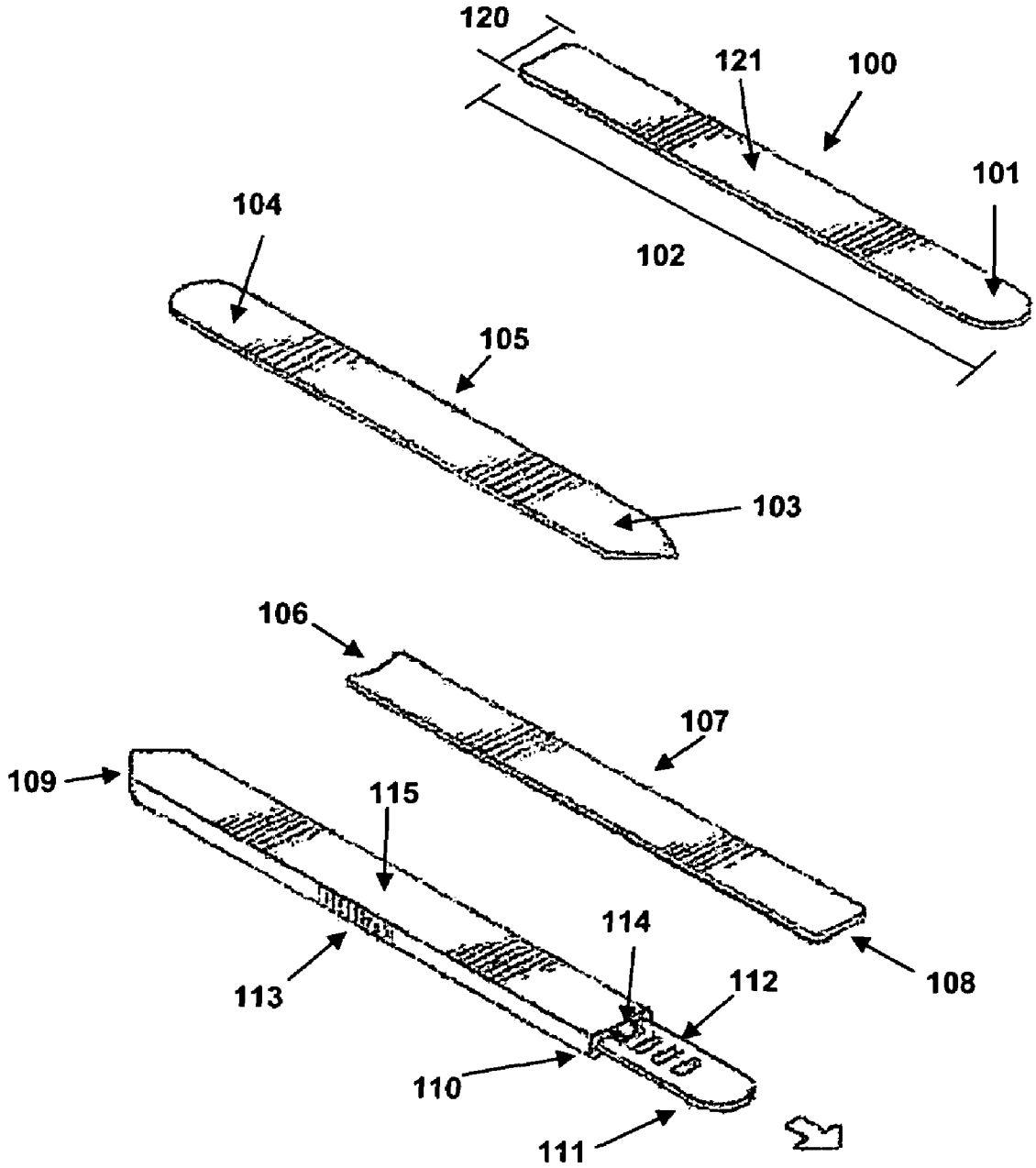
FIG. 1 illustrates several embodiments of a linen cover extension device according to one aspect of the present invention.

FIG. 1 illustrates several embodiments of a linen cover extension device according to one aspect of the present invention. A linen cover extension device, illustrated as extension device 100, includes an elongated substrate of material 121 having a length 102 and a width 120. Extension device 100 includes at least one rounded end portion 101. Elongated substrate may be formed from a flexible or rigid material such as a plastic, paper, rubber, cardboard, etc. operable to provide extend a fabric or material used to provide a linen. Extension device 100 may further include various dimensions. For example, length 102 may be provided between one (1) and three (3) inches although other lengths may also be used. Additionally, width 120 may vary between a quarter of an inch and a half inch. Other widths may also be employed as well. Various types of coupling mechanisms may be employed to couple extension device 100 to a linen cover. For example, extension device 100 may be provided with an adhesive material, a hook and loop material, etc. to couple extension device 100 to a linen cover. Additionally, extension device 100 may be provided in a variety of colors to match a color of a linen.

During use, extension device 100 may be provided in association with a linen cover such as a pillow case. For example, extension device 100 may be coupled to a corner of a decorative pillow case (not expressly shown) to ensure that a ruffle located along a perimeter of a pillow case is extended away from the perimeter of a pillow case allowing the ruffle to be viewed when a pillow is placed on a surface such as a bed, couch, etc. In this manner, decorative materials that may not be rigid enough to stand up on their own may be used. For example, fine silk materials, Egyptian cottons, polyester material, etc. having various thickness may be used in association with a linen cover and extension device 100 may be provided to ensure that material along a perimeter of a linen cover may be presented.

In one embodiment, an extension device may include various types of end portions. For example, a pointed-tip extension device 105 may be provided and includes a pointed end portion 103 and a rounded end portion 104. Pointed end portion 103 may be placed at a corner of a linen cover that may include corners that may be provided at a point (i.e. a ninety-degree corner). As such pointed end portion 103 may be placed at a corner extended a corner of a fabric using pointed end portion 103. In another embodiment, a user may utilize rounded end portion 104 at a perimeter or corner of a linen cover. For example, a linen cover may include a rounded edge (not expressly shown) and as such a user may couple pointed-tip extension device 105 such that rounded end portion 104 is placed along a rounded edge of a linen cover. Other types of extension devices may also be used. For example, a square tipped extension device 107 having a square tip 106 and 108 may also be employed. For example, a square tipped extension device 107 may be placed along at a position proximal or distal from a corner of a linen cover. Square tip 106 and/or 108 may then interface a substantially straight portion of a perimeter edge to provide support of a portion of a linen cover along various points of a perimeter of a linen cover. In this manner, one or more types of extensions may be used with a linen cover at various points of a perimeter to extend a portion of the linen cover.

In one embodiment, a telescopic extension device 113 may be provided and may include a housing 115 having an end portion 110 sized to allow insertion of an elongated substrate 111 having slots 112 for engaging a locking mechanism 114 to fix telescopic device at a length. Telescopic extension device 113 is illustrated with a pointed end portion 109 although other portions may also be employed. During use, a user may release locking mechanism 114 and extend elongated substrate 111 along housing 115 to a desired length and lock locking mechanism 114 in a slot 112. A user may then place telescopic extension device 113 along a perimeter of a linen cover to extend a portion of the linen cover away from the perimeter (not expressly shown). Housing 115 and/or elongated substrate 111 may be formed from various materials and in one embodiment is formed from a plastic material. Locking mechanism 114 may be activated or released in various ways. For example, locking mechanism 114 may be active through pressing a top portion of locking mechanism causing a tab to disengage a slot 112. In another embodiment, locking mechanism 114 may be released or activated though pressing a the side of housing 115 near opening 110 and elongated substrate may extended or retracted as needed. A user may then release housing 115 and locking mechanism 114 may engage a slot 112 to provide a new length. Various other types of locking mechanisms may also be employed.

Figure 2:
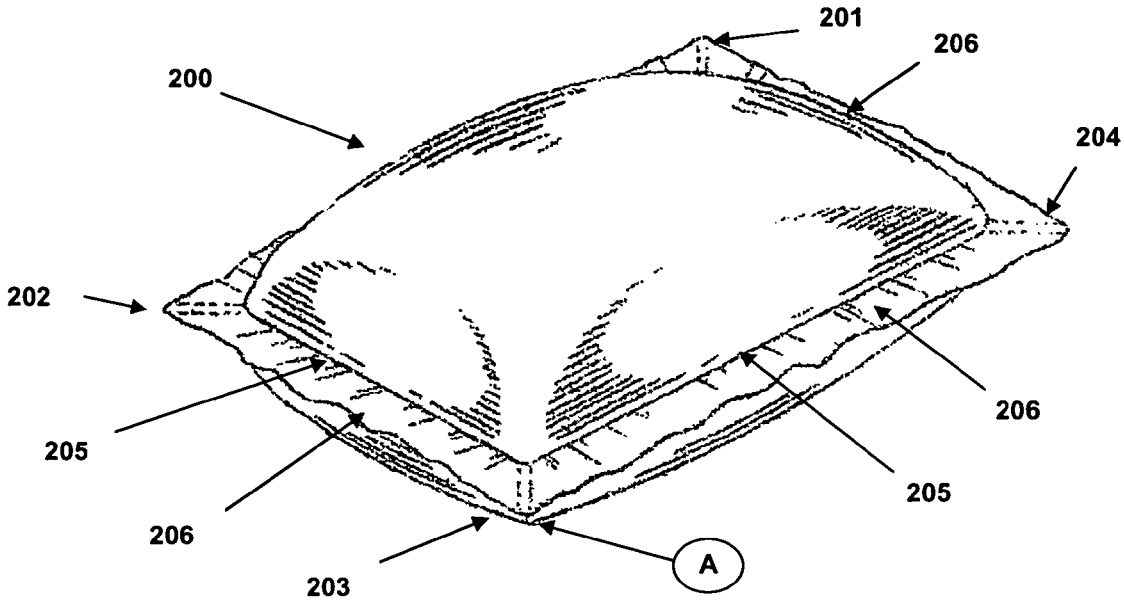
FIG. 2 illustrates a linen cover incorporating a linen cover extension cavity according to one aspect of the invention.
Figure 2:
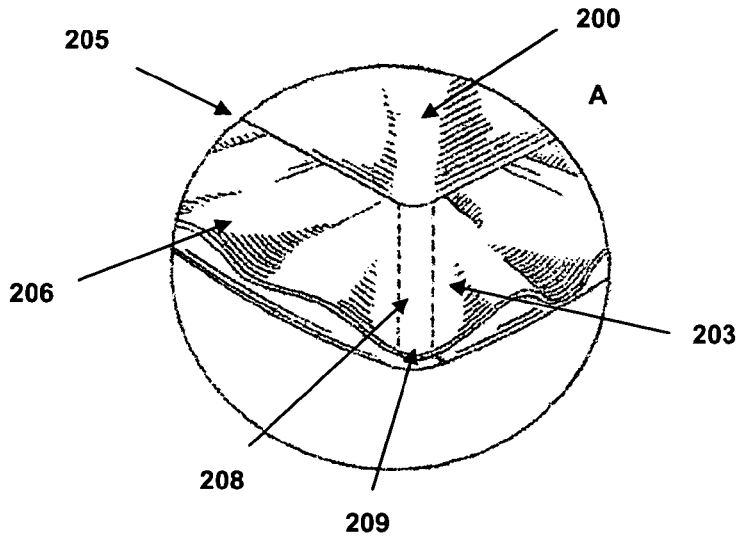

FIG. 2 illustrates a linen cover incorporating a linen cover extension cavity according to one aspect of the invention. A linen cover, illustrated generally as pillow case 200, includes first corner 201, a second corner 202, a third corner 203 and a fourth corner 204 positioned along a perimeter 205 of pillow case 200. Pillow case 200 may be formed from a single or multiple pieces of material and includes a perimeter 205 having a ruffle 206 extending from perimeter 205. Each corner 201, 202, 203, 204 of pillowcase 200 includes a cavity operable to receive an extension device. Detail A of FIG. 2 illustrates a cavity 208 that includes an opening 209 to allow for insertion of an extension device such as extension device 100 illustrated in FIG. 1. In one embodiment, pillowcase 200 may be provided with an extension device sewn into or coupled to each corner 201, 202, 203, 204. However, in other embodiments, pillowcase 200 may be provided with an opening allowing a user to remove and replace an extension device as needed. For example, opening 209 may include a flap material that may be separated or open and closed to allow access to an extension device. In this manner, an extension device may be secured within cavity 208 while allowing an extension device may be removed and replaced as needed.

Note that although an embodiment of the invention has been shown and described in detail herein, along with certain variants thereof, many other varied embodiments that incorporate the teachings of the invention may be easily constructed by those skilled in the art. Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. Accordingly, the invention is not intended to be limited to the specific form set forth herein, but on the contrary, it is intended to cover such alternatives, modifications, and equivalents, as can be reasonably included within the spirit and scope of the invention.

What is claimed is:

1. A device for extending a portion of a fabric material of a linen cover at a corner edge of the linen cover comprising:

an elongated substrate of flexible material having a length, a first end and a second end; and a coupling mechanism operable to secure the elongated substrate to the corner edge of the linen cover and extend a portion of the linen cover a distance from a perimeter of the linen cover; and a housing operable to house the elongated substrate and slidingly engage the elongated substrate to provide an increased length, wherein the increased length is operable to be varied between one (1) inch and three (3) inches.

2. A linen cover operable to be used with a device for extending a portion of a fabric material of the linen cover at a corner edge of the linen cover, the linen cover comprising:

a material formed into a cover sized to extend over a pillow;

a ruffle extending from a perimeter edge portion of the cover; and a cavity formed from the material at a corner of the cover and operable to receive the device to extend the ruffle a distance from the perimeter edge portion.

3. The cover of claim 2 further comprising four cavities formed at four corners of the cover.

4. The cover of claim 3, wherein each cavity comprises the same dimensions.

5. The cover of claim 4, wherein each cavity comprises a flap portion operable to be opened to insert the device and closed to secure the device within the cavity.

6. The cover of claim 2, further comprising the cavity formed at approximately forty-five (45) degrees relative to the perimeter edge portion.

7. The cover of claim 2, further comprising the cavity formed into a channel having a width less than approximately one (1) inch.

8. The cover of claim 7, further comprising the cavity having a length less than approximately three (3) inches.

9. A device for extending a portion of a fabric material of a linen cover at a corner edge of the linen cover comprising:

an elongated substrate of flexible material having a length between approximately two (2) inches and three (3) inches and a width no greater than approximately one quarter of an inch; and a coupling mechanism operable to secure the elongated substrate to the corner edge of the linen cover and extend a portion of the linen cover a distance from a perimeter of the linen cover, the linen cover comprising:

a material formed into a cover sized to extend over a pillow;

a ruffle extending from a perimeter edge portion of the cover; and a cavity formed from the material at a corner of the cover and operable to receive the elongated substrate to extend the ruffle a distance from the perimeter edge portion.

* * * * *